US011270840B2

(12) United States Patent
Harris et al.

(10) Patent No.: US 11,270,840 B2
(45) Date of Patent: Mar. 8, 2022

(54) MAGNET PRODUCTION

(71) Applicant: The University of Birmingham, Birmingham (GB)

(72) Inventors: Ivor Rex Harris, Birmingham (GB); Allan Walton, Birmingham (GB); Oliver Peter Brooks, Birmingham (GB)

(73) Assignee: The University of Birmingham, Birmingham (GB)

( * ) Notice: Subject to any disclaimer, the term of this patent is extended or adjusted under 35 U.S.C. 154(b) by 453 days.

(21) Appl. No.: 15/740,593

(22) PCT Filed: Jul. 1, 2016

(86) PCT No.: PCT/GB2016/052001
§ 371 (c)(1),
(2) Date: Dec. 28, 2017

(87) PCT Pub. No.: WO2017/001868
PCT Pub. Date: Jan. 5, 2017

(65) Prior Publication Data

US 2018/0190428 A1 Jul. 5, 2018

(30) Foreign Application Priority Data

Jul. 1, 2015 (GB) ..... 1511553

(51) Int. Cl.
*H01F 41/02* (2006.01)
*H01F 1/057* (2006.01)

(52) U.S. Cl.
CPC ..... *H01F 41/026* (2013.01); *H01F 1/0573* (2013.01)

(58) Field of Classification Search
None
See application file for complete search history.

(56) References Cited

U.S. PATENT DOCUMENTS

| | | | |
|---|---|---|---|
| 2009/0032147 | A1 | 2/2009 | Nozawa |
| 2012/0244030 | A1 | 9/2012 | Maeda |

FOREIGN PATENT DOCUMENTS

| | | |
|---|---|---|
| CN | 103426623 | 12/2013 |
| CN | 2016800383792 | 5/2019 |
| GB | 15115538 | 2/2016 |
| JP | H05-152115 | 6/1993 |

(Continued)

OTHER PUBLICATIONS

JPlatPat machine translation of JP 2015-026795 (Year: 2020).*

(Continued)

*Primary Examiner* — Alexandra M Moore
*Assistant Examiner* — Christopher D. Moody
(74) *Attorney, Agent, or Firm* — Wells St. John P.S.

(57) ABSTRACT

A process is provided for the production of rare earth magnets comprising the steps of exposing a rare earth alloy to hydrogen gas at an elevated temperature so as to effect hydrogenation and disproportionation of the alloy, mechanically processing the disproportionated alloy, and degassing the processed alloy so as to effect hydrogen desorption and recombination of the alloy. The process of the invention finds use in the production and shaping of rare earth magnets, and may be particularly applicable to the production of thin magnetic sheets.

19 Claims, 10 Drawing Sheets

(56) References Cited

FOREIGN PATENT DOCUMENTS

| | | | | |
|---|---|---|---|---|
| JP | H09-143514 | | 6/1997 | |
| JP | H09260121 | | 10/1997 | |
| JP | H10106875 | | 4/1998 | |
| JP | 2009-064877 | | 3/2009 | |
| JP | 2012-104711 | | 5/2012 | |
| JP | 2012-216804 | | 11/2012 | |
| JP | 2015-007275 | | 1/2015 | |
| JP | 2015-026795 | | 2/2015 | |
| JP | 2015026795 | A * | 2/2015 | ..... H01F 1/055 |
| JP | 2017-568117 | | 12/2019 | |
| WO | PCT/GB2016/052001 | | 12/2016 | |
| WO | PCT/GB2016/052001 | | 1/2018 | |

OTHER PUBLICATIONS

JPlatPat machine translation of JP 2012-216804 (Year: 2020).*
Espacenet machine translation of CN 103426623 (Year: 2020).*
The Free Dictionary [Internet]. "bulk solid". McGraw-Hill Dictionary of Scientific & Technical Terms, 6E, The McGraw-Hill Companies, Inc., 2003 [cited Nov. 6, 2020], Available from: https://encyclopedia2.thefreedictionary.com/bulk+solid (Year: 2020).*
J Plat Pat machine translation of JP H09-143514 (Year: 2021).*
Harris, "Hydrogen: its use in the processing of NdFeB-type magnets", Journal of the Less-Common Metals, vol. 172-174 (Jan. 1, 1991), pp. 1273-1284.
Yu, "Desorption-recombination behavior of as-disproportionated NdFeCoB compacts by reactive deformation", Rare Metals, vol. 34, No. 2 (Jan. 8, 2015), pp. 89-94.

* cited by examiner (a)

(b)

(a)

(b)

(c)

MAGNET PRODUCTION

The present invention relates to a process for producing magnets. In particular, the invention relates to a process for producing rare earth magnets.

Rare earth magnets, in particular permanent magnets of the NdFeB type (neodymium iron boron magnets), are known for their higher coercivity (resistance to demagnetisation) than conventional magnets. Such magnets have found application in a wide range of electrical components such as hard-disk drives (HDDs), electric motors (EMs) in electric and hybrid vehicles (EHVs) and in wind turbine generators (WTGs).

Fully dense or sintered NdFeB magnets are typically manufactured via a complex powder processing route from either cast NdFeB type alloys or by recycling sintered NdFeB magnets which are recovered from spent electronic devices. For example, in the well-established Hydrogen Decrepitation (HD) process, cast NdFeB alloys or recovered NdFeB magnets are reacted with hydrogen gas (typically at room temperature and 1-10 bar pressure) to decrepitate the bulk material into a friable powder. The cast alloys and recovered magnets consist of a $Nd_2Fe_{14}B$ matrix phase and a Nd rich boundary phase. The Nd rich boundary phase reacts with the hydrogen first, forming $NdH_{2.7}$ in an exothermic reaction. This exothermic reaction is sufficient to allow the $Nd_2Fe_{14}B$ matrix phase to react with hydrogen forming an interstitial hydride solution of $Nd_2Fe_{14}BH_x$ ($x \approx 3$). This hydride formation results in a differential volume expansion (~5%) of the crystal structure and the brittle structure fractures to form a friable powder.

The decrepitated powder is air sensitive (due to the presence of the hydride components) and it may react with moisture in the air, resulting in an undesirable increase in oxygen content and the formation of rare earth oxides and hydroxides (e.g. at triple points forming $Nd_2O_3$ and $Nd(OH)_3$). The subsequent handling and manipulation of the friable decrepitated powder must therefore be conducted in an inert atmosphere. The use of additives such as dysprosium (Dy), which is in limited supply and thus expensive, may also be required to obtain high coercivities in the NdFeB magnets produced.

If necessary, the decrepitated powder can be reduced further to a finer powder by, for example, jet milling. Once milled, a magnetic field is applied to align the grains of the powdered material and thus achieve anisotropy. The material is then pressed and sintered at around 1000° C. to produce a magnet. In the case of recovered rare earth magnet material, it may be necessary to add small amounts of blending agents, such as $NdH_2$, in order to give a certain amount of clean, metallic rare earth rich phase which is essential for sintering to full density.

Sintered rare earth magnets are brittle and are therefore extremely difficult to shape. For certain applications (e.g. high speed motors in, for example, the automotive sector) it is desirable to produce rare earth magnets in thin sheets which can be placed in layers with insulating sheets between, thereby increasing the performance of the magnets by reducing the eddy-current losses. Currently, the only way to manufacture such thin magnets is to slice the sheets from a solid sintered block. However, this process is very time consuming and results in a significant amount of the magnetic material being lost as waste.

In practice, in an attempt to overcome the difficulties in shaping brittle rare earth magnets, particles of melt-spun ribbon consisting of nanocrystalline grains of magnet material are often mixed with a binder to produce a range of bonded magnets.

However, these binders are non-ferromagnetic and hence result in a dilution of the magnetic strength. This effect can be reduced by employing anisotropic HDDR-based powder.

HDDR (Hydrogenation, Disproportionation, Desorption and Recombination) is a well-known process which is used to achieve grain refinement and alignment in powdered alloys such as NdFeB. The main aim of HDDR is to convert a coarser grained structure into a fine grain, highly coercive powder for use in the production of anisotropic polymer bonded magnets. The process typically involves heating NdFeB powder in $H_2$ to high temperatures (generally around 750-900° C.), and then, whilst still at high temperatures, desorbing the $H_2$ under carefully controlled conditions. During the hydrogenation and disproportionation stages, initially the Nd-rich grain boundary material reacts with the $H_2$ to form a hydride, and subsequently the matrix grains of $Nd_2Fe_{14}B$ disproportionate to form an intimate mixture of $NdH_2$, $Fe_2B$ and α-Fe, according to the general reaction:

$$Nd_2Fe_{14}B+2H_2 \rightleftharpoons 2NdH_2+Fe_2B+12Fe$$

When the pressure is subsequently reduced (e.g. by vacuum application) the hydrogen desorbs from the disproportionated material and the three constituents recombine to give grains of $Nd_2Fe_{14}B$ but with a much reduced grain size. The grain size is typically reduced from approximately 5-500 microns in the starting material to approximately 300 nm in the HDDR material and this reduction results in a substantial improvement in the coercivity of the magnets.

The present invention seeks to provide an improved process for the production of rare earth magnets or to overcome or ameliorate at least one of the problems of the prior art processes, or to provide a useful alternative.

According to a first aspect of the present invention, there is provided a process for the production of rare earth magnets, the process comprising the steps of:

- exposing a rare earth alloy to hydrogen gas at an elevated temperature so as to effect hydrogenation and disproportionation of the alloy;
- mechanically processing the disproportionated alloy; and
- degassing the processed alloy so as to effect hydrogen desorption and recombination of the alloy.

Surprisingly, it has been found that a disproportionated NdFeB alloy has improved ductility as compared to a powder produced by hydrogen decrepitation of the same material. Without being bound by theory, it is thought that the improved ductility of a disproportionated NdFeB may be related to the free iron constituent which is present in large quantities in the disproportionated material. An advantage arising from the improved ductility is that the alloy can be more readily mechanically processed and shaped without fracturing. The invention takes advantage of the increased ductility of the material in the intermediate disproportionated state by combining a HDDR process with mechanical processing of the material in the intermediate disproportionated state. The present invention thus provides a process which facilitates the production and shaping of rare earth magnets, and which may be particularly applicable to the production of thin magnetic sheets.

In some embodiments, the rare earth alloy is selected from NdFeB, $SmCo_5$, $Sm_2(Co,Fe,Cu,Zr)_{17}$ and $SrFe_{12}O_{19}$. As is known by those skilled in the art, the transition metal content of $Sm_2(Co,Fe,Cu,Zr)_{17}$ is typically rich in cobalt but also contains other metals such as iron, copper and/or zinc.

In some embodiments, the rare earth alloy is NdFeB.

The rare earth alloy may be exposed to pure hydrogen gas, or it may be exposed to a mixture of hydrogen gas with one or more inert gases, for example nitrogen or argon. By "inert" it will be understood that the gas is non-reactive with the rare earth magnets under the conditions of use. In some embodiments, the rare earth alloy is exposed to an atmosphere comprising no more than 80% hydrogen, no more than 50% hydrogen or no more than 30% hydrogen. In some embodiments, the rare earth alloy is exposed to an atmosphere comprising at least 10% hydrogen, at least 40% hydrogen, at least 70% hydrogen or at least 90% hydrogen. The use of a non-explosive gas mixture simplifies the processing equipment and makes handling of the gas safer.

In some embodiments, the pressure (or partial pressure where a mixture of gases is used) of hydrogen gas is from 1 mbar to 20 bar, from 0.1 bar to 10 bar, from 0.5 bar to 5 bar, or from 1 bar to 3 bar. In some embodiments, the pressure (or partial pressure where a mixture of gases is used) of hydrogen gas is approximately 1 bar. Over a wide range of temperatures the equilibrium pressure for NdH2 is very low so that the disproportionation reaction can be achieved over a wide range of pressures and temperatures. The higher the pressure of hydrogen the faster is the disproportionation reaction.

In some embodiments, the hydrogen gas (or the mixture of gases if used) is introduced at a rate of from 10 to 20 mbar $min^{-1}$.

The rare earth alloy is exposed to the hydrogen gas for a period of time which is necessary to effect disproportionation of the alloy. It will be appreciated that the period of time necessary to effect disproportionation will depend on factors including the batch size of the alloy, the hydrogen gas pressure and the temperature at which the method is carried out. In some embodiments, the alloy is exposed to the hydrogen gas for a period of time from 30 minutes to 48 hours, from 1 hour to 24 hours, from 1 hour to 12 hours, from 1 hour to 5 hours or from 2 hours to 4 hours.

Exposing a rare earth alloy to hydrogen in accordance with the method of the invention effects hydrogenation and disproportionation of the alloy. As is known by those skilled in the art, "disproportionation" is a reaction in which the alloy dissociates into at least two constituents which are different to the compound of the alloy, but which are formed from the same elements as the alloy.

For example, in embodiments wherein the rare earth alloy is NdFeB having a $Nd_2Fe_{14}B$ matrix phase and a Nd rich boundary phase, the disproportionated alloy comprises the constituents neodymium hydride ($NdH_2$), ferroboron ($Fe_2B$) and predominantly iron ($\alpha$-Fe). The disproportionated material has been found by the present inventors to have much improved ductility which is thought to be attributable to the free iron ($\alpha$-Fe) constituent. This improved ductility enables the alloy to be more readily mechanically processed without external fracturing.

The formation of the disproportionated constituents can be observed by carrying out scanning or transmission electron microscope (SEM or TEM) studies on the disproportionated material.

The disproportionation may be complete or partial. When the disproportionation is complete, then none of the original alloy compound will be present, i.e. only the disproportionated constituents will be present. When the disproportionation is partial, then the original alloy compound will be present in addition to the at least two disproportionated constituents. Substantially incomplete disproportionation results in the presence of the brittle matrix phase, thus reducing the ductility.

In some embodiments, the rare earth alloy is exposed to hydrogen gas so as to effect complete disproportionation of the alloy.

The rare earth alloy used in the process may be a bulk solid (e.g. a cast ingot, solid sintered magnet, melt spun or strip cast flakes) or it may be a powder (e.g. powder resulting from the breakdown of melt spun ribbons, hydrogen decrepitated powder or recycled magnet powder). In some embodiments, the rare earth alloy is a bulk solid. The use of a bulk solid alloy is preferred since powdered rare earth materials are typically air-sensitive and typically require handling in an inert atmosphere. Provided that the hydrogen is introduced into the alloy at elevated temperature then the sample integrity can be maintained and external fracturing can be avoided.

Thus, an advantage of certain embodiments of the present invention is the production of aligned magnets via a non-powder route. Therefore, in comparison with some of the conventional manufacturing routes, some embodiments of the invention avoid the need for the careful handling of an air sensitive powder (e.g. under an inert atmosphere) while keeping the oxygen content of the resulting magnets to a comparatively lower level.

In some embodiments, the process further comprises casting a molten rare earth alloy into a mould and solidifying the alloy, prior to exposing the alloy to hydrogen gas. The alloy may be removed from the mould prior to exposing the alloy to hydrogen, or the alloy may remain in the mould during the hydrogenation and disproportionation step.

Surprisingly, the inventors have discovered that when a bulk solid rare earth alloy material is physically constrained (e.g. within a metal tube) whilst being exposed to hydrogen gas over a wide range of conditions, hydrogenation occurs without the alloy breaking apart into a powder.

Thus, in some embodiments, the rare earth alloy is constrained during the step of exposing the alloy to hydrogen gas so as to effect hydrogenation and disproportionation.

By "constrained" it will be understood that the rare earth alloy is at least partially confined within a constraining element. In some embodiments, the rare earth alloy is sealed within the constraining element. The constraining element may be, but is not limited to, a mould, a tube, a sleeve or a ring. The constraining element may be partly or entirely formed of metal, such as copper or stainless steel.

In some embodiments, the constraining element is formed of a ductile material. A "ductile material", as used herein, is any metal or alloy which is capable of plastic deformation under ambient conditions (i.e standard temperature and pressure). An example of a suitable ductile material is copper. Constraining the alloy within a ductile material will facilitate the subsequent deformation process and result in the finished magnet having a thin coating of the material forming the constraining element. This provides both mechanical and corrosion stability.

The process may further comprise placing the rare earth alloy within a constraining element prior to exposing the alloy to hydrogen.

In some embodiments, the process comprises exposing a rare earth alloy to hydrogen gas at elevated temperature, wherein the rare earth alloy is constrained within a mould.

In some embodiments, the process comprises casting a molten rare earth alloy into a mould, solidifying the alloy and, while the cast alloy is within the mould, exposing the cast alloy to hydrogen gas.

In such embodiments, the cast alloy may be exposed to hydrogen gas soon after the casting step while the cast is still hot. This saves on the energy required to heat the cast alloy to an elevated temperature sufficient to effect hydrogenation and disproportionation.

In addition, the inventors have surprisingly found that a constrained rare earth alloy undergoes hydrogenation and disproportionation at lower temperatures when compared with the temperatures which are required to effect hydrogenation and disproportionation of an unconstrained alloy. Without being bound by theory, it is thought that local increases in temperature due to the constrained nature of the sample and the exothermicity of the hydrogenation and disproportionation reactions allow for a much lower reaction temperature than that anticipated from normal kinetic arguments. Thus, a further advantage of some embodiments of the present invention is that the hydrogenation and disproportionation may be carried out at a lower temperature than that of the prior art HDDR processes.

It will be appreciated that the elevated temperature at which the rare earth alloy is exposed to hydrogen must be sufficient to effect hydrogenation and disproportionation of the alloy.

In embodiments wherein the rare earth alloy is constrained, the elevated temperature is at least 400, at least 450, at least 500 or at least 550° C.

In some embodiments, the elevated temperature is at least 600, at least 650, at least 700, at least 750 or at least 800° C.

In some embodiments, the rare earth alloy is exposed to hydrogen gas at an elevated temperature of no more than 1000, no more than 900 or no more than 800° C.

In some embodiments wherein the rare earth alloy is constrained, the elevated temperature is no more than 700, no more than 600 or no more than 500° C.

It will be appreciated that the precise temperature employed will be additionally dependent on a number of factors including, for example, the alloy batch size and/or the composition of the alloy. With larger batches of the alloy the exothermic hydrogenation and disproportionation reactions may be larger and it is therefore anticipated that a lower temperature may be employed to initiate the disproportionation reaction.

In some embodiments, the process further comprises a step of homogenising the disproportionated alloy. Homogenisation is carried out under $H_2$. In some embodiments, homogenisation is carried out at a temperature of at least 800° C. or at least 900° C., for example at around 950° C. Homogenisation may be carried out for at least 2 hours, at least 4 hours, at least 6 hours, at least 8, at least 10 or at least 12 hours. In some embodiments homogenisation is carried out for a period of from 1 to 12 hours, from 2 to 8 hours, or from 3 to 5 hours.

In some embodiments, the rare earth alloy is exposed to hydrogen gas at 1 bar at around 950° C. to effect disproportionation, and then the disproportionated material is homogenised at around 950° C. for about 6 hours.

Homogenisation may help to optimise the microstructure of the recombined alloy material, for example by reducing cavitation at stoichiometric composition. Inclusion of a homogenisation step is particularly advantageous when the rare earth alloy starting material is a cast alloy. To minimise the extent of the cavitation on recombining the multiphase alloy to produce a very fine grain with high coercivity, it is necessary to employ a very near stoichiometric ($Nd_2Fe_{14}B$) composition $NdH_2$ or $NdCu_4Al_4$ may be added subsequently. This means that, in the fully homogenised state, the amount of intragranular Nd-rich phase is very limited or absent. However, because the alloy forms by a peritectic reaction, in the as-cast condition there will be significant levels of free iron together with corresponding regions of Nd-rich compositions. This is not the case for the rapidly cast alloy such as the melt-spun and/or strip cast alloy or those cast alloys containing small quantities of di-boride additions. In the case of a book-cast alloy, homogenisation treatment may help to reduce or eliminate the non-homogeneous free Fe and Nd-rich regions. The use of a stoichiometric composition also maximises the proportion of the permanent magnet component and eliminates cavitation.

Alternatively, cavitation may be reduced by applying a mechanical force to the alloy during the recombination process.

In some embodiments, the process comprises the steps of:

casting a molten rare earth alloy into a mould and solidifying the alloy to provide a cast alloy;

while the cast alloy is constrained within the mould, exposing the cast alloy to hydrogen gas at a temperature of at least 400° C. so as to effect hydrogenation and disproportionation of the alloy;

mechanically processing the disproportionated alloy; and degassing the processed alloy so as to effect hydrogen desorption and recombination of the alloy.

The process may further comprise the step of extracting the recombined alloy from the constraining element (e.g. the mould). In some embodiments, extraction from the constraining element may be carried out prior to or after degassing.

In some embodiments, mechanically processing the disproportionated alloy comprises pressing, rolling, compacting, shaping and/or extruding the disproportionated alloy. These processes can be carried out while the alloy is hot, or when it is cold. In some embodiments, the disproportionated alloy is hot pressed in a mould (for example, the mould in which the alloy was cast). Disproportionation also makes cold compaction of the powder easier.

In some embodiments, mechanically processing the disproportionated alloy comprises forming the alloy into sheets. In some embodiments, the sheets have a thickness of no greater than 2 cm, no greater than 1 cm, no greater than 0.5 cm or no greater than 0.1 cm. In some embodiments, the sheets have a thickness of at least 0.01 mm, at least 0.05 mm, at least 0.1 mm or at least 0.5 mm.

The process may further comprise forming (e.g. by punching, stamping or cutting) discrete pieces from a sheet of the rare earth alloy in order to provide individual magnets. The step of forming the discrete pieces from the sheet may be carried out before or after degassing.

Mechanical processing of a disproportionated cast alloy could induce texture in the material which, in turn, could produce a preferred crystallographic orientation of the grain and so help to form anisotropic magnets. In contrast, non-disproportionated materials cannot be mechanically processed because they are brittle.

It will be understood that during the degassing step of the process hydrogen is desorbed from at least one of the disproportionated constituents in the processed disproportionated material such that these constituents recombine to re-form the original alloy compound. For example, in embodiments wherein the alloy is NdFeB, the disproportionated material comprises $NdH_2$, $Fe_2B$ and $\alpha$-Fe which recombine to give NdFeB following hydrogen desorption. Disproportionated powder will be more compactible and can therefore be cold forged to form fully dense compacts prior to recombination.

Careful control of the degassing procedure can assist in the alignment of the grains during recombination and thus the production of anisotropic magnets with improved remanence (magnetic strength) and/or (BH)max values.

In some embodiments, the processed alloy is degassed at a temperature of no more than 1000, 900, 800, 700, 650, 600, 550, 500 or 450° C. In some embodiments, the processed disproportionated alloy is degassed at a temperature of at least 25, 50, 100, 150, 200, 250, 300, 350 or 400° C. In some embodiments, the processed disproportionated material is degassed at a temperature of from 200 to 900, 300 to 800, 350 to 850 or 400 to 800° C. In some embodiments, degassing is carried out at a temperature of from 600-700° C., e.g. about 650° C.

In some embodiments, the processed disproportionated alloy is degassed by the application of a vacuum. In some embodiments the processed alloy is degassed at a pressure of at least 6 mbar, at least 10 mbar, or at least 50 mbar. In some embodiments, the processed alloy is degassed at a pressure of no more than 1 bar, no more than 0.5 bar or no more than 100 mbar.

In some embodiments, the rate of pressure reduction is no more than 1 bar/min, no more than 0.5 bar/min, no more than 0.1 bar/min or no more than 0.05 bar/min. In some embodiments the rate of pressure reduction is at least 0.1 mbar/min, at least 0.5 mbar/min or at least 1 mbar/min.

In some embodiments, the processed alloy is degassed for a period of time from 30 minutes to 48 hours, 1 hour to 24 hours, 1 hour to 12 hours, 1 hour to 5 hours, 1 hour to 4 hours or 2 hours to 4 hours.

The recombined alloy may comprise grains of reduced size in comparison with the grains of the original alloy. Prior to disproportionation, the rare earth alloy may have a grain size ranging from 1 (min) to 500 μm (max), from 2 to 100 μm or from 5 to 50 μm. The recombined alloy (i.e. following degassing) may have a maximum grain size of less than 1 μm or less than 500 nm, for example approximately 300 nm. The reduced grain size leads to higher coercivity (resistance to demagnetisation), which in turn means that less of the expensive dysprosium (Dy) additive is required.

In some embodiments, the process further comprises a step of cooling the alloy. Cooling may be carried out prior to and/or during degassing and/or after degassing. In some embodiments wherein cooling is carried out after disproportionation and prior to degassing, cooling may be carried out in the presence of hydrogen. A hydrogen pressure of in the region of 0.3-0.8 bar (e.g. approximately 0.5 bar), may be used. This helps to maintain the material in the disproportionated state.

In comparison with conventional methods for producing fully dense sintered magnets, the process of the invention reduces the number of steps involved in the manufacturing process. This, in turn also reduces the production costs.

According to a second aspect of the present invention, there is provided a process for treating a rare earth alloy, the process comprising exposing a constrained rare earth alloy to hydrogen gas at elevated temperature so as to effect hydrogenation and disproportionation of the alloy.

It will be appreciated that embodiments described above in relation to the first aspect of the invention may apply equally to the second aspect of the invention as appropriate.

Embodiments of the invention will now be described by way of example only, with reference to the accompanying drawings in which.

Figure 5:
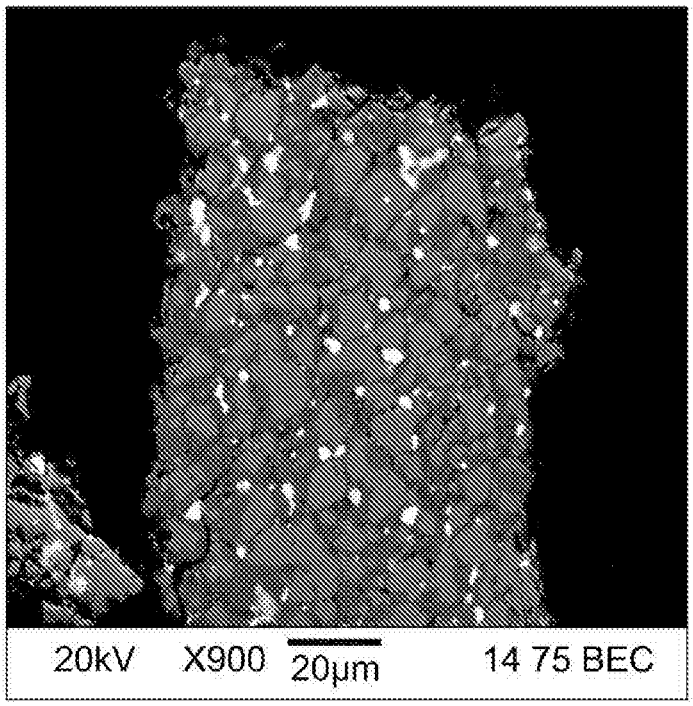
Figure 5:
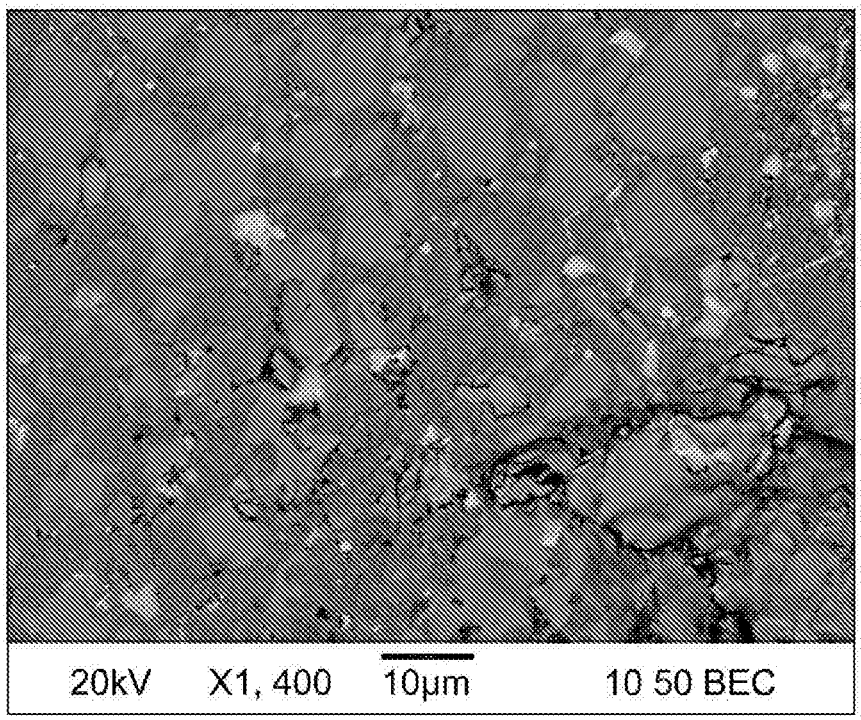
Figure 6:
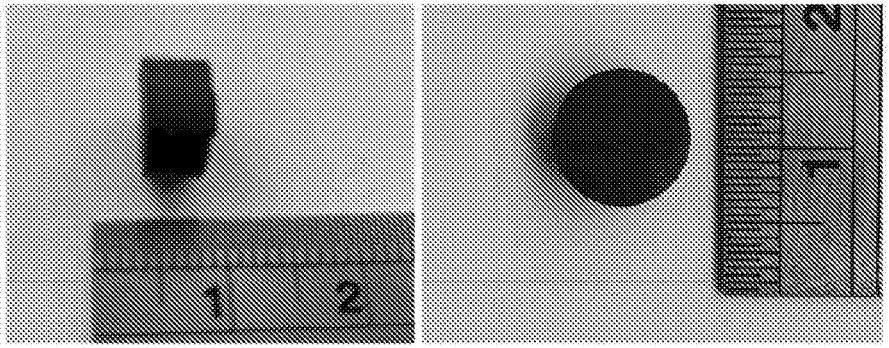
Figure 6:
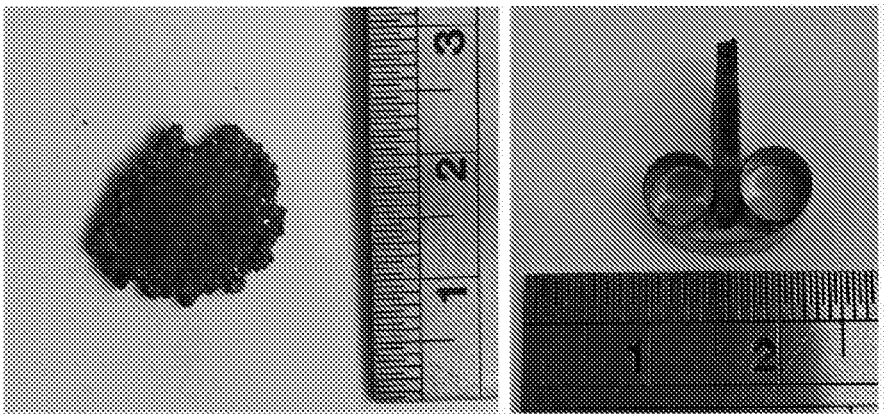
Figure 6:
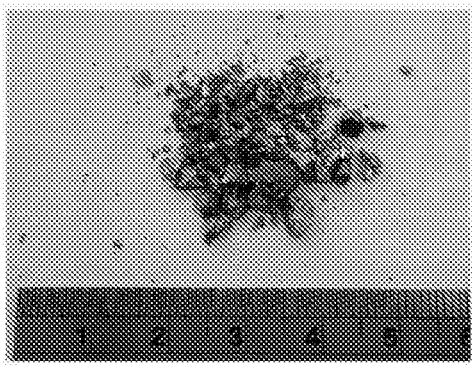
Figure 7:
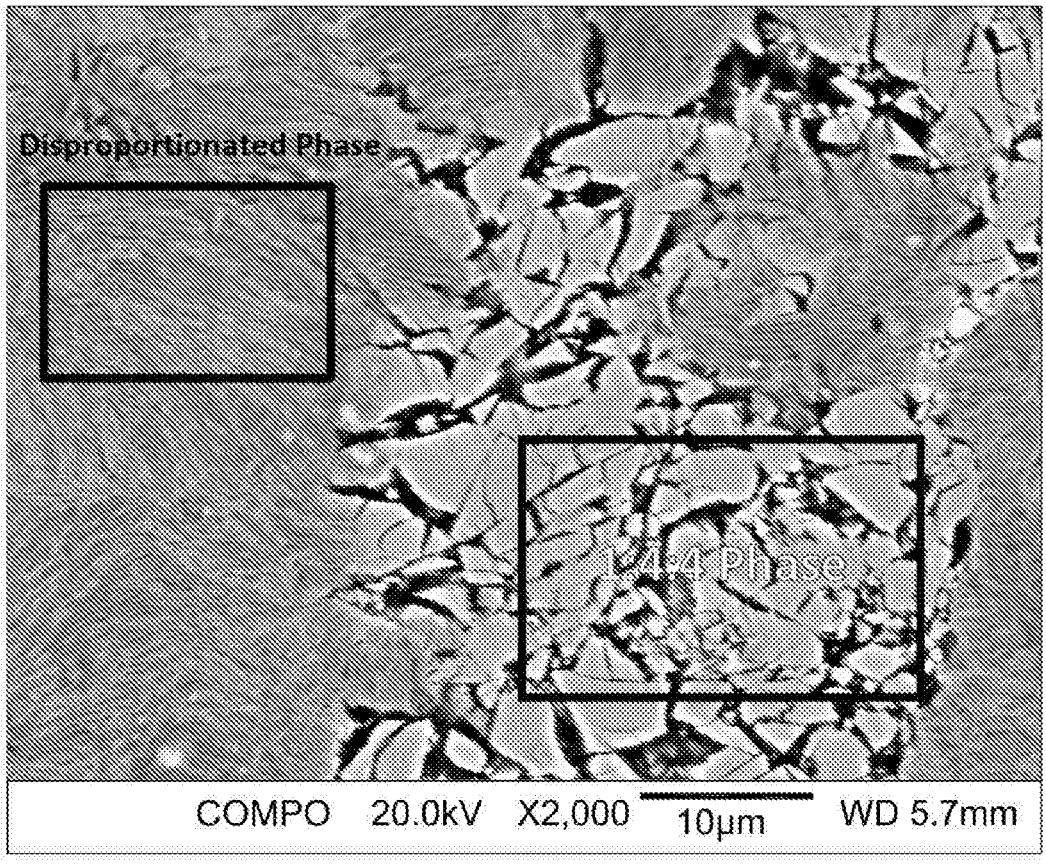
Figure 8:
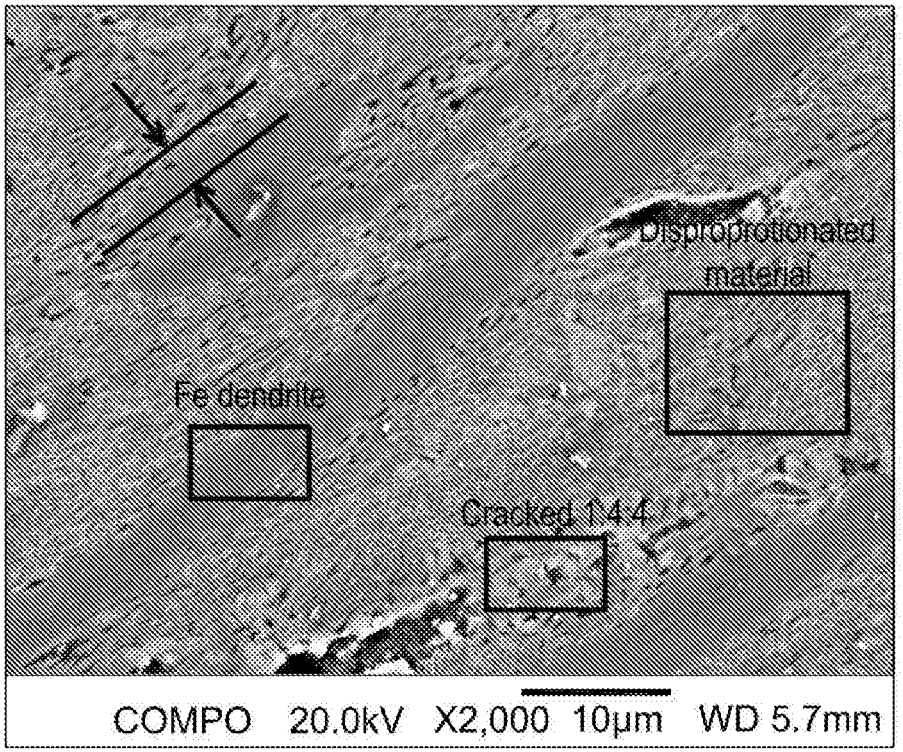
Figure 9:
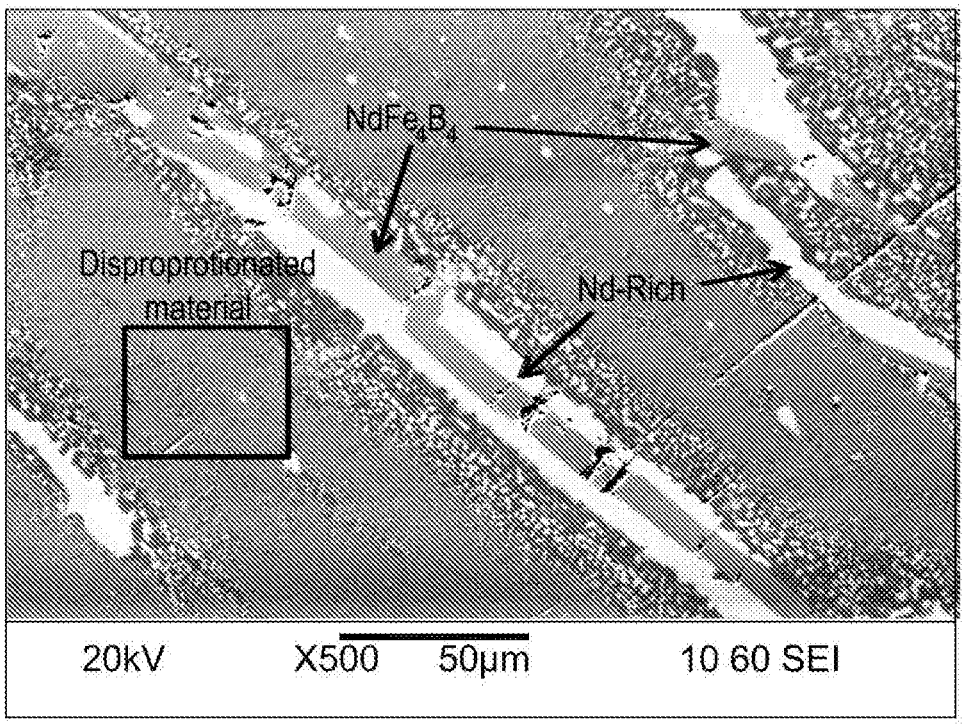
Figure 10:
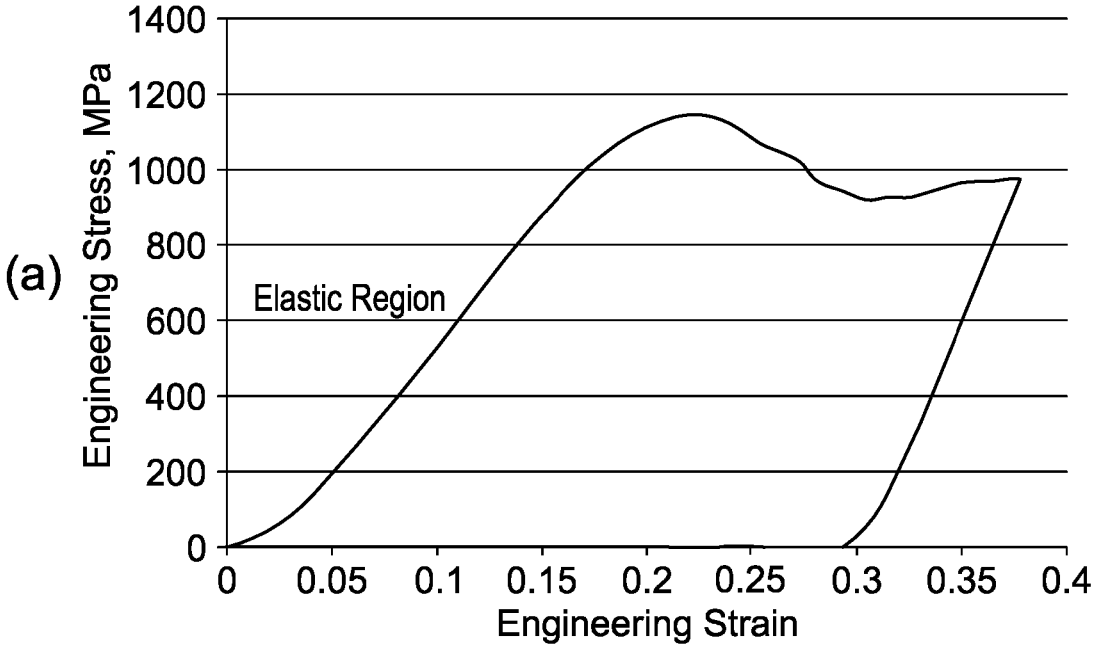
Figure 10:
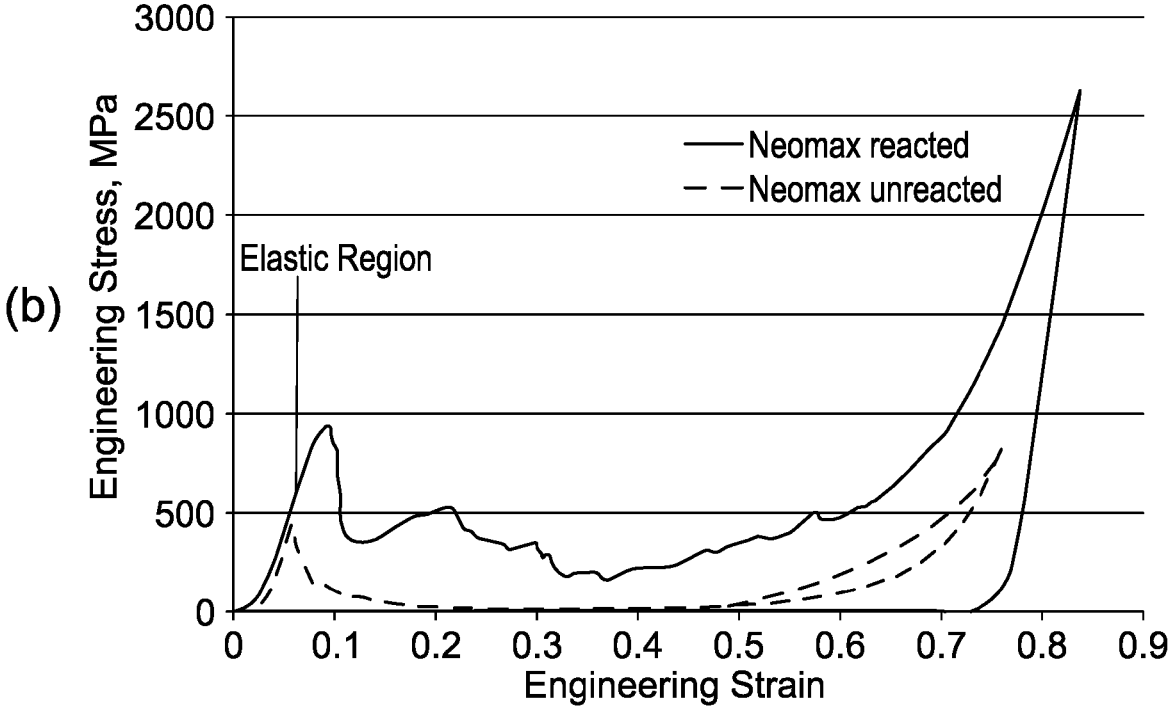
Figure 11:
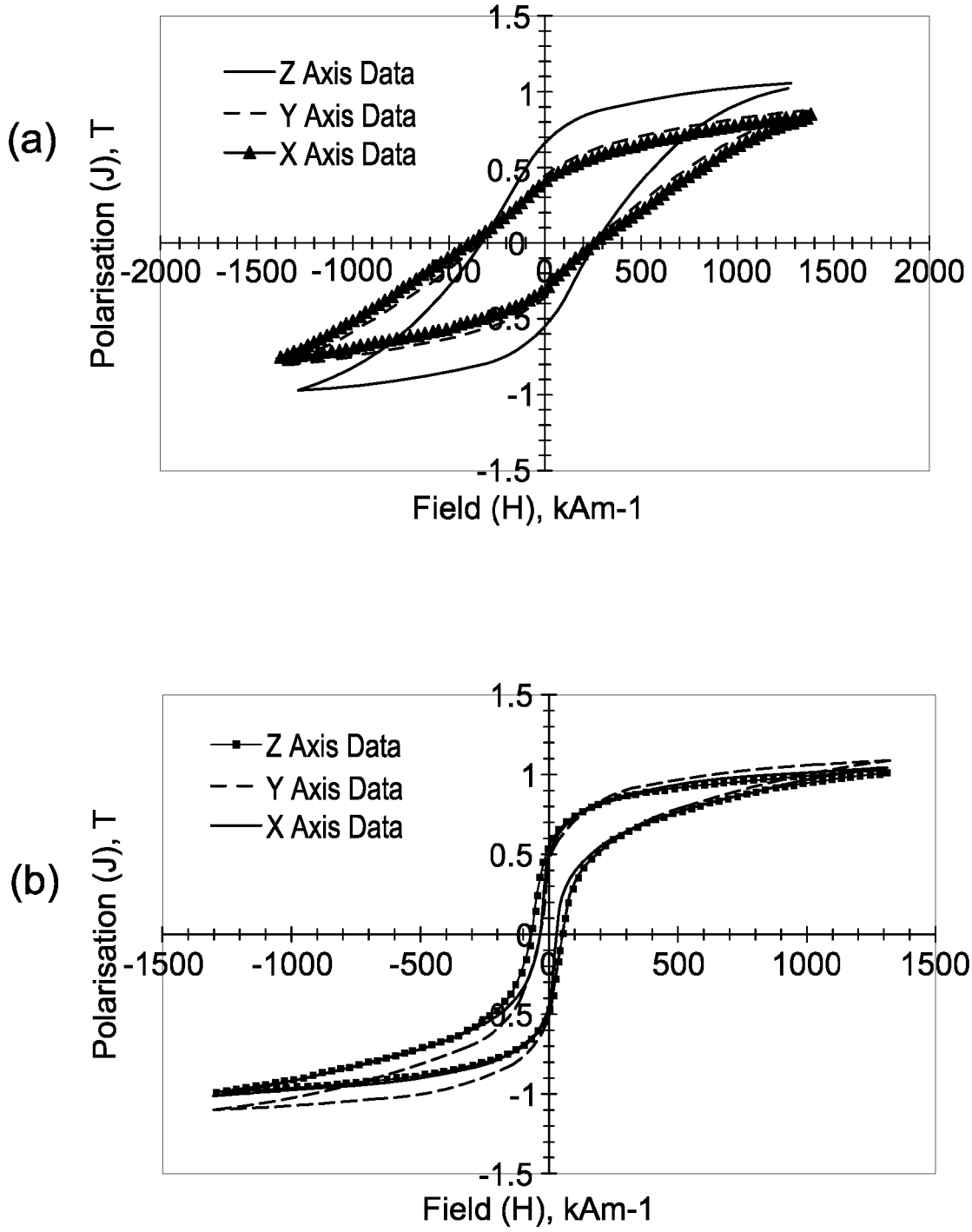

FIG. 5*a* shows a SEM micrograph of partially disproportionated material following exposure of a NdFeB type alloy to hydrogen gas under conventional hydrogenation and disproportionation conditions;

FIG. 5*b* shows a SEM micrograph of partially disproportionated material following exposure of a constrained NdFeB type alloy to hydrogen gas under hydrogenation and disproportionation conditions according to an embodiment of the present invention;

FIG. 6*a* shows a cylinder of hydrogen-treated NdFeB material;

FIG. 6*b* shows a cylinder of hydrogen-treated NdFeB material after compression at 20 tonnes;

FIG. 6*c* shows a cylinder of untreated NdFeB material after compression at 20 tonnes;

FIG. 7 is a back-scattered SEM image of a region of a treated $Nd_{12.2}Fe_{81.3}B_5$ alloy after disproportionation and compression;

FIG. 8 is a back-scattered SEM image of a region of a treated $Nd_{12.2}Fe_{81.3}B_{6.5}$ alloy after compression, where the compression axis is indicated by arrows;

FIG. 9 is a back-scattered SEM image of a region of a treated $Nd_{15}Fe_{77}B_8$ alloy after compression;

FIG. 10*a* is a stress-strain curve of a treated $Nd_{12.2}Fe_{81.3}B_{6.5}$ alloy compressed at a rate of 0.5 mm/min;

FIG. 10*b* is a stress-strain curve of a treated $Nd_{15}Fe_{77}B_8$ alloy and an untreated alloy compressed at a rate of 0.5 mm/min;

FIG. 11*a* is a magnetic hysteresis loop for a treated $Nd_{15}Fe_{77}B_8$ alloy after compression and recombination; and FIG. 11*b* is a magnetic hysteresis loop for a treated $Nd_{15}Fe_{77}B_8$ alloy after recombination only.

COMPARATIVE EXAMPLE 1: CONVENTIONAL MANUFACTURING ROUTE

Figure 1:
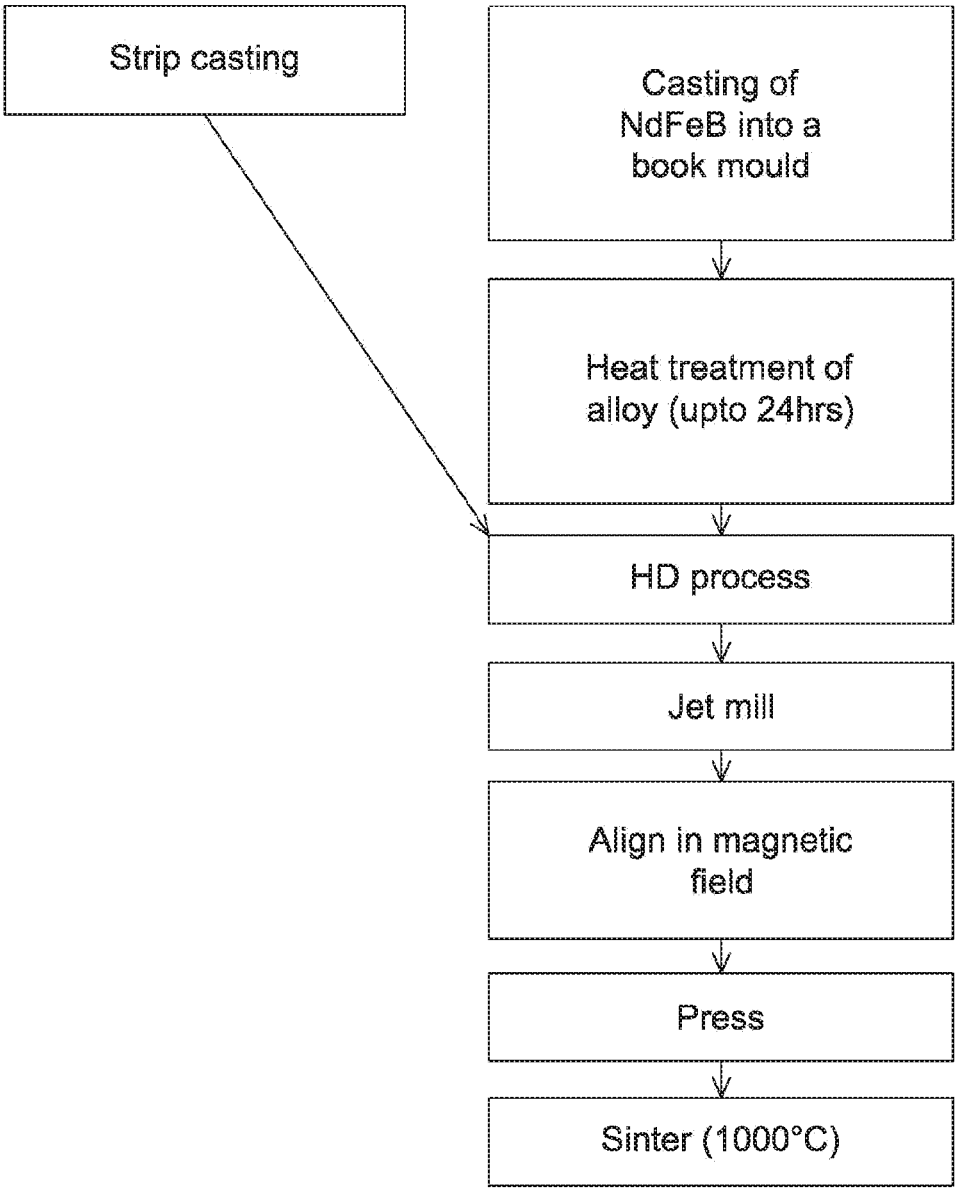
Figure 1 (PRIOR ART)
FIG. 1 shows a schematic flow diagram of a conventional manufacturing route for producing sintered NdFeB magnets.

FIG. 1 shows a schematic flow diagram of a conventional manufacturing route for producing fully dense sintered NdFeB magnets. The molten NdFeB type alloy may be cast, using standard casting procedures such as book moulding or strip casting. In book moulding, the molten alloy is poured into a suitable mould and cooled to form an ingot. Free iron (α-Fe) may form on the surface of the casting and which reduces the ease of processing of the ingot. Heat treatment of the alloy, for a period of up to 24 hours, may therefore be required to remove the free iron. Alternatively, in strip casting, the molten NdFeB type alloy is poured onto a cooled copper wheel and the NdFeB type alloy solidifies into flakes. Strip casting suppresses the formation of free iron since the free iron does not have time to form.

The cast NdFeB type alloy is then reacted with hydrogen gas at room temperature to effect decrepitation of the alloy into a friable powder. Since the friable powder is air sensitive, the powder has to be stored and transported under an inert atmosphere (e.g. argon) and it is preferable to carry out all subsequent steps of the process in an inert atmosphere. The friable powder is then jet milled to reduce the size of the powder particles.

The particles of the milled powder are then aligned in a magnetic field and subsequently pressed to provide a green compact. Green compacts produced in this way will typically have a density of approximately 69% of the theoretical density of the finished magnet.

The pressed green compact is then sintered at a temperature of approximately 1000° C. The sintering process is required to further increase the density of the green compact and provide the fully dense NdFeB type magnet.

EXAMPLE 2: MANUFACTURING ROUTE USING HDDR PROCESS

Figure 2:
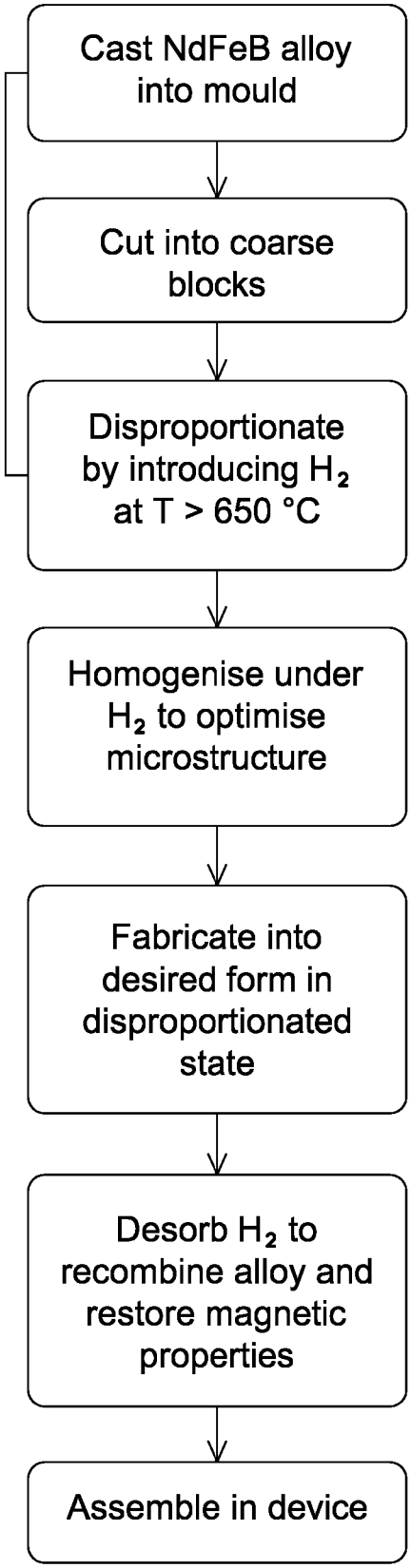
FIG. 2 shows a schematic flow diagram of a process for producing NdFeB magnets according to an embodiment of the present invention.

FIG. 2 shows a schematic flow diagram of a manufacturing route for producing fully dense NdFeB magnets according to an embodiment of the invention. A molten NdFeB type alloy is cast, using standard casting procedures, into a mould and solidified. The cast NdFeB type alloy is then cut into coarse blocks being exposed to pure hydrogen gas (1 bar) at a temperature of over 650° C. to effect hydrogenation and disproportionation of the alloy into $NdH_2$, $Fe_2B$ and predominantly α-Fe.

The disproportionated material is homogenised under hydrogen gas (1 bar) at ~950° C. for up to 12 hours, such as 3-5 hours, to optimise the microstructure of the material.

The material is then mechanically processed by, for example, hot pressing or cold compaction to form a green compact. The green compacts produced in this way will typically have a density of approximately 94% of the theoretical density of the finished magnet.

In alternative embodiments, the disproportionated material could be extruded or hot rolled into thin sheets, followed by punching of the thin sheets to provide discrete pieces of material that will eventually form individual magnets.

Following hot pressing, the processed disproportionated material is degassed under vacuum at a temperature of around 650° C. to effect hydrogen desorption and recombination of the NdFeB type alloy. The resulting magnet can then be placed into a device, such as a motor.

Figure 3:
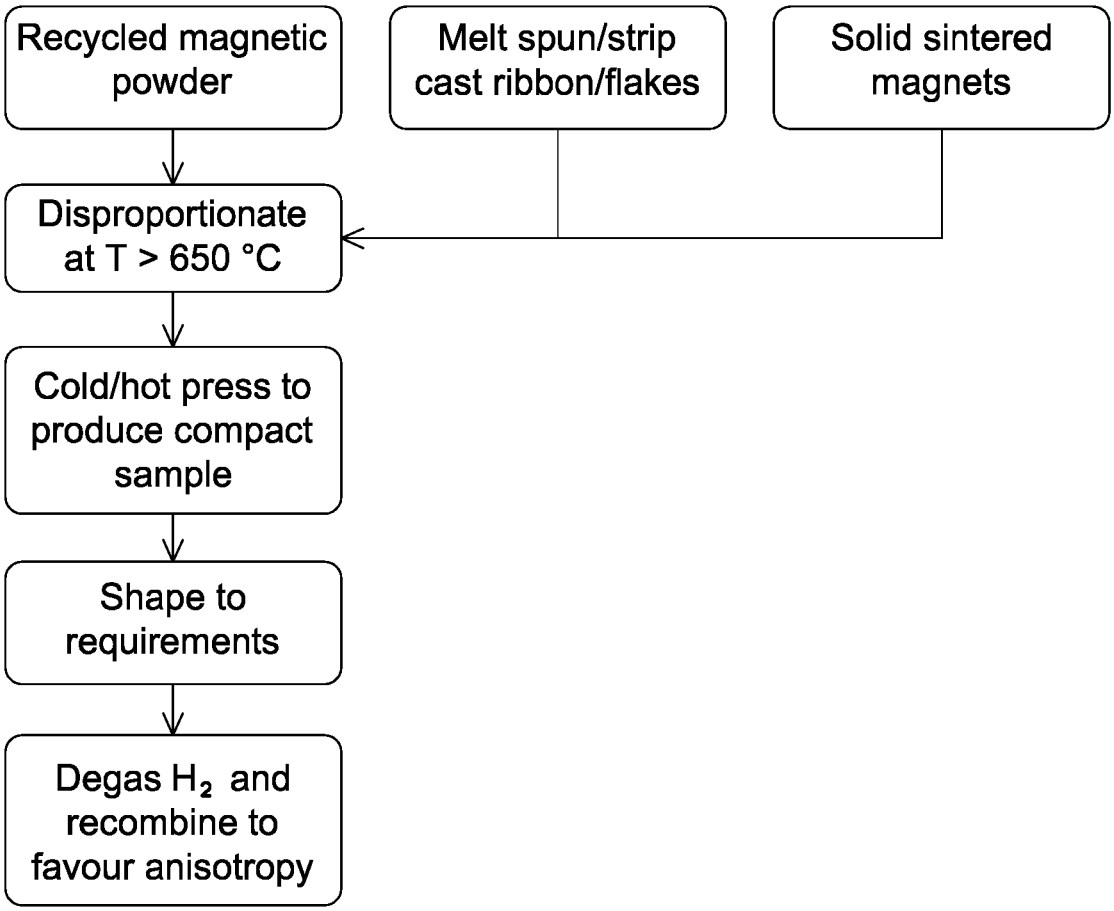
FIG. 3 shows a schematic flow diagram of a process for producing NdFeB magnets according to another embodiment of the present invention.
Figure 4:
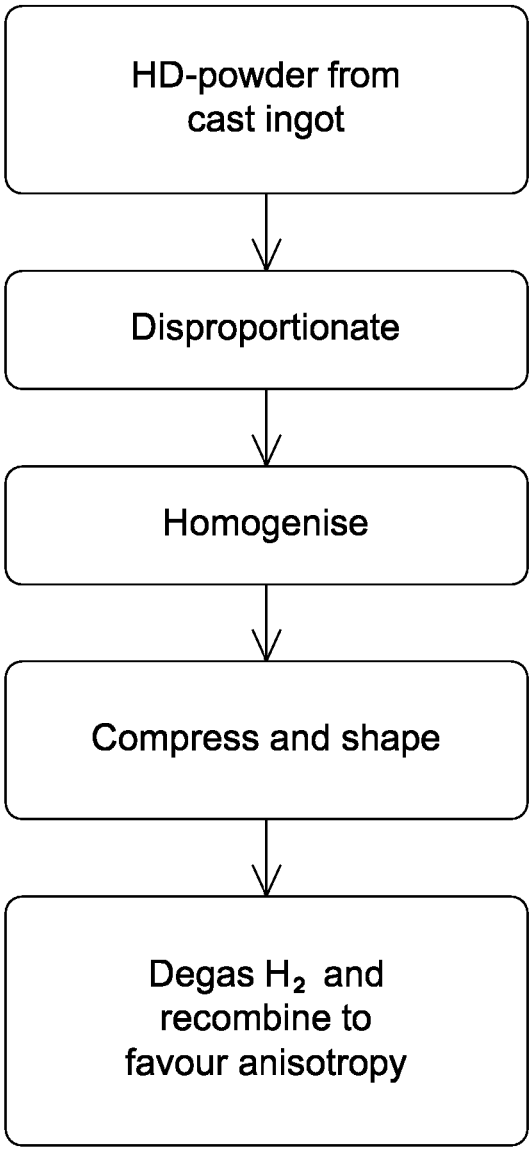
FIG. 4 shows a schematic flow diagram of a process for producing NdFeB magnets according to a further embodiment of the present invention.

With reference to FIGS. 3 and 4, a process in accordance with an embodiment of the invention can similarly be applied using recycled magnetic powder, melt spun or strip cast ribbon or flakes, solid sintered magnets, or powder obtained by the hydrogen decrepitation (HD) of a cast ingot. As with the cast alloy, these materials are first disproportionated by exposure to hydrogen at a temperature of over 650° C. Optionally, the disproportionated material is homogenised (FIG. 4). The disproportionated material is then compressed, for example by hot or cold pressing, to produce a compact, which is then shaped. The shaped material is then degassed under vacuum at a temperature of around 650° C.

These processes results in the production of a fully dense aligned rare earth magnet without the need to produce an air-sensitive powder. Processes in according with the invention enable the production of rare earth magnets with a significant reduction in the number if process steps and materials wastage. The increased ductility of the intermediate disproportionated material allows the shaping of the alloy as desired.

EXAMPLE 3: DISPROPORTIONATION STUDIES

The formation of the disproportionated constituents can be observed by carrying out SEM studies on the disproportionated material. FIG. 5*a* shows a SEM micrograph of a partially disproportionated material following exposure of a NdFeB type alloy to hydrogen gas at a temperature of 880° C., i.e. under conventional hydrogenation and disproportionation conditions. The grey regions are where very fine mixtures of $NdH_2$, $Fe_2B$ and α-Fe have formed.

FIG. 5*b* shows a SEM micrograph of a partially disproportionated material following exposure of a constrained NdFeB type alloy to hydrogen gas. A sample of NdFeB was placed within a copper sleeve at exposed to hydrogen gas (1 bar) at a temperature of 400° C. for 6 hours. The presence of the grey regions in the SEM image indicates that the initiation of the disproportionation reaction at the original grain boundaries has occurred at a much lower temperature than that anticipated from normal kinetic arguments. This may be a result of local increases in temperature due to the constrained nature of the NdFeB type alloy and to the associated exothermicity of the hydrogenation and disproportionation reactions.

EXAMPLE 4: DUCTILITY STUDIES

The ductility of the solid bulk disproportionated material obtained from hydrogenation and disproportionation of NdFeB was assessed by measuring the density of green compacts obtained by pressing the disproportionated material.

Powdered NdFeB was exposed to hydrogen at a rate of 10 mbar/min up to 1200 mbar, at a temperature of 875° C., and held for 1 hour to effect hydrogenation and disproportionation. SEM was used to determine that disproportionation was complete and that the NdFeB had fully converted to the constituents $NdH_2$, $Fe_2B$ and α-Fe.

A uniaxial compacting pressure of 10 tonnes was applied to a 1 cm diameter die set containing the disproportionated material to form a green compact. The green compact formed from the solid bulk disproportionated material was found to have a density of 6.95 g/cc, and held its shape. The theoretical density of the final magnets produced is calculated to be 7.5 g/cc. Thus, the solid bulk disproportionated material was compacted to approximately 94% densification.

In contrast, upon pressing the brittle, friable $Nd_2Fe_{14}BH_3$ powder obtained from hydrogen decrepitation of NdFeB, the green compact was found to have a density of 5.13 g/cc. Thus, the brittle, friable powder was compacted to approximately 69% densification.

In a further experiment, solid cast NdFeB was exposed to hydrogen at a rate of 10 mbar/min up to 980 mbar at 800° C. and held at temperature and pressure for 2 hours to effect solid hydrogenation and disproportionation. Again SEM was used to determine that disproportionation was complete and density was measured to be 6.87 g/cc.

A uniaxial compacting pressure of 20 tonnes was applied to a 2 cm diameter die set containing the solid disproportionated material. The compact formed from the solid disproportionated material was found to have a density of 7.26 g/cc and a height change from 0.41 cm to 0.13 cm. Thus, the solid disproportionated material was compacted to approximately 97% densification.

The much higher density of the disproportionated material compared to the decrepitated material and the large change in height of the solid disproportionated material indicates that the disproportionated material has a significantly improved ductility.

EXAMPLE 5: DISPROPORTIONATION STUDIES

In this study, cast material of compositions $Nd_{12.2}Fe_{81.3}B_{6.5}$ and $Nd_{15}Fe_{78}B_7$ were employed. The materials were cut either into cylinders of ~9.5 mm diameter and ~5 mm in height, or cubes of ~5×5×5 mm, using spark erosion, since this technique limits the chance of oxidation which could influence the disproportionation reaction.

Disproportionation Technique

To achieve disproportionation, the samples were heated under vacuum 915° C., and hydrogen was introduced to a pressure of 1200 mbar for varying periods of time of up to 6 hours. This technique avoids the hydrogen decrepitation process which occurs at lower temperatures, thus producing a completely solid material rather than a powder, and allowing compression, stress-strain measurements to be undertaken. The conditions were also adjusted to avoid formation of the more reactive $NdH_{2.7}$ component, by cooling rapidly to room temperature under vacuum then heating to 350° C. with a 30-minute hold to remove $H_2$. After a period of time sufficient to achieve 100% disproportionation (approximately 5 hours), the material was then cooled in hydrogen (1200 mbar) in order to maintain the disproportionated state.

Compression Trials

In order to assess whether there had been any radical change in mechanical behaviour resulting from disproportionation, both treated and untreated samples were compressed in 10 mm diameter specac die sets with an Atlas T25 press capable of a load of up to 20 tonnes.

Microscopy

A Joel 6060 and Joel 7000 scanning electron microscopes were employed in backscattered mode using 20 kV accelerating voltage in order to examine the structure of the disproportionated material both before and after deformation, in an attempt to relate the mechanical behaviour to any changes in the microstructure.

Magnetic Measurements

A Lakeshore vibrating sample magnetometer (VSM), capable of up to 1.5 T, was used to measure the magnetic properties of the material before and after compression.

Results and Discussion

The initial trials were carried out on the alloy $Nd_{12.2}Fe_{81.3}B_{6.5}$ and specimens of this alloy were subject to a rapid compression test both in the initial condition and after the solid hydrogen disproportionation treatment by the method described above. The samples were compressed in a die set up to a maximum load of 15915 tonnes/$m^2$. This provided a rapid means of assessing any effect of the hydrogen treatment on the mechanical behaviour prior to more detailed stress/strain measurements.

SEM Results

SEM analysis of the $Nd_{12.2}Fe_{81.3}B_{6.5}$ starting material revealed three phases in the material; several large dark areas, several light spots and a large grey area. Because the composition of the alloy was near that of stoichiometry and the 2/14/1 phase (large grey areas) area formed by a peritectic reaction, then some dendrites of free Fe were seen together (dark areas). A possible unseen phase of $NdFe_4B_4$ may also be present in the material.

SEM analysis of the $Nd_{15}Fe_{77}B_8$ starting material revealed that, unlike the $Nd_{12.2}Fe_{81.3}B_{6.5}$ starting material, the material has no dark regions of Fe dendrites. Several larger areas of light Nd rich as well as a large area of the 2/14/1 phase were observed. Removing the Fe dendrites will considerably improve the magnetic properties of the recombined material.

After hydrogen treatment of the $Nd_{12.2}Fe_{81.3}B_{6.5}$ material, the large majority phase of 2/14/1 had transformed into a much finer disproportionated structure. The dark regions of Fe dendrites remained as they will not react with hydrogen but have a coarser disproportionated structure surrounding them. The small bright areas of Nd rich still remain after treatment. As well as this a new phase has appeared, confirmed by EDX to be $NdFe_4B_4$. Under the conditions employed in these experiments, there was no evidence of any reaction of this phase with hydrogen.

The same hydrogen treatment was applied to the $Nd_{15}Fe_{77}B_8$ material. The majority of the 2/14/1 material was transformed into the disproportionated phase, the lighter areas of Nd rich were still present and there was also a phase of $NdFe_4B_4$ material present along the Nd rich grain boundary which had become clearer after the formation of the disproportionated matrix.

Initial Compression Trials

Cylinders of NdFeB material were cut by a spark erosion technique to sizes of ~9 mm diameter and varying heights from 4.1-5.4 mm (FIG. 6*a*). These samples were then compressed in a 20 mm diameter die set, in air, up to a load of 7 tonnes (~1095 MPa), producing extensive cracking and disintegration of the untreated sample. In the disproportionated sample, only a minor change in height of 1.5% and no noticeable change in diameter was observed.

The load was then increased to the maximum setting of 20 tonnes (~3130 MPa). In the case of the treated samples, the compression dramatically changed the shape of the material which experienced a height change of up to 70%. The thin compacts could be handled without falling into a powder with little to no powder being left behind after the compression test (FIG. 6*b*). In contrast, untreated sample cracked and fell apart (FIG. 6*c*).

These simple trials emphasise the dramatic change in mechanical behaviour after the hydrogen treatment with the untreated material exhibiting very little ductility. This dramatic change has been confirmed by the subsequent, more carefully controlled, compression trials.

It can be surmised that the highly ordered $NdFe_4B_4$ will be of a similar brittle nature to that of $Nd_2Fe_{14}B$. This was confirmed by further SEM analysis of a region of a treated $Nd_{12.2}Fe_{81.3}B_{6.5}$ alloy after compression, as shown in FIG. 7. A critical feature of this microstructure is that all of the cracking was confined to a phase which was identified by EDX (Energy Dispersive A-ray analysis) as $NdFe_4B_4$. The extensive ductility of this sample can therefore be ascribed completely to the behaviour of the disproportionated mixture.

SEM analysis of a compressed sample revealed that where the disproportionated mixture had coarsened at the interface with the iron dendrites, it was possible to discern the elongated nature of the iron component such that the minor axis was perpendicular to the direction of compression (FIG. 8). This further confirmed the ductile nature of the disproportionated material.

The density of the s-HD material was determined by weighing the sample in air and then in diethyl phthalate. The untreated cast material exhibited a density 7.548 $gcm^{-3}$. After disproportionation the density of the material was measured to be 7.154 $gcm^{-3}$, and once compressed by 20 tonnes this value was measured to be 7.067 $gcm^{-3}$. The maximum possible density of stoichiometric disproportionated $Nd_2Fe_{14}B$ is 7.18 $gcm^{-3}$ The difference between this value and the value measured is due to the Fe dendrites and $NdFeB_4$ phases present in the book mould material.

FIG. 9 shows the hydrogen-treated $Nd_{15}Fe_{77}B_8$ material after compression. Much like the stoichiometric material, the $NdFe_4B_4$ material has begun to fracture whilst the disproportionated structure remains completely intact.

Mechanical Testing

Cylinders (~9 mm diameter and ~5 mm height) of the disproportionated cast materials were compressed in order to ascertain the detailed stress-strain behaviour of the various samples. FIG. 10*a* shows the curves for the hydrogen treated $Nd_{12.2}Fe_{81.3}B_{6.5}$ cast material.

FIG. 10*b* shows the stress-strain curve for treated and untreated $Nd_{15}Fe_{77}B_8$ material. The apparent yield point for the hydrogen treated material and the unreacted material is dramatically reduced from 983 MPa to 446 MPa—almost a 50% reduction of the original stress. There is also a marked reduction in the elastic region for the Neomax alloy. There is still a stress relief after this point and this ends with a rapid increase in stress at around 67% change in thickness. The remarkable feature of FIG. 10*b* is the overall reduction in thickness of some 75% and, of this, up to 65% can be achieved at a very low stress level.

Recombination Process

After the compression trials, some of the samples were recombined by heating under vacuum to 900° C. at a rate of 10° C./minute and then cooled rapidly to room temperature. This treatment produced a solid sample with no powder break off and this resulted in a slight rise in density to 7.278 $gcm^{-3}$. This increase can be attributed to the transformation back to $Nd_2Fe_{14}B$. The formation of cavitation, as shown by SEM, will lower the overall density as will the extensive cracking of the NdFe4B4 phase. Another distinctive feature of the microstructure is the ragged interface with the Fe dendrites which is indicative of the partial homogenisation process.

Magnetic Measurements

FIG. 11*a* shows the magnetic hysteresis loop for a treated $Nd_{15}Fe_{77}B_8$ sample which has been compressed and recombined. The z direction is the direction of compression and these results would suggest that the compression has had an effect on the alignment of the material producing an easy axis.

In FIG. 11*b* the magnetic hysteresis loop for a recombined $Nd_{15}Fe_{77}B_8$ sample is shown. This sample has undergone no compression and shows no signs of magnetic alignment. Instead one finds that there is actually a decrease in the magnetic coercivity of the sample.

CONCLUSION

The present investigations have demonstrated very clearly that the normally extremely brittle NdFeB-based alloys can be converted to a ductile form by the application of the solid disproportionation process. The present studies have shown that the intimate mixture of predominantly Fe and NdH2 exhibits substantial ductility and any brittleness originates from the presence of the NdFe4B4 which is fractured extensively after the compression treatment. Preliminary magnetic data has been obtained on the recombined material under present conditions has shown that it is possible to introduce anisotropy in the material through compression.

Thus embodiments of the process of the present invention may provide one or more of the following advantages:

The ability to provide magnets in a desired shape (e.g. a thin sheet) without the loss of material as caused by current shaping techniques. The invention makes use of the surprising finding that disproportionated material has increased ductility by pressing, rolling, extruding or otherwise forming the rare earth alloy while it is in the disproportionated state, prior to recombination. Deformation give alignment of grains, especially in the z direction, and improved magnetic properties;

The provision of a process for producing fully dense and aligned rare earth magnets which avoids the use of an air-sensitive powder, in contrast to the known process based on hydrogen decrepitation;

The provision of a process for producing fully dense and aligned rare earth magnets which involves fewer steps than known processes. In particular, the finding that exposing a constrained alloy to hydrogen reduces the temperature required for hydrogenation and disproportionation means that certain embodiments of the invention have reduced energy requirements.

The invention claimed is:

1. A process for the production of rare earth magnets via a non-powder route, the process comprising the steps of:

exposing a rare earth alloy to hydrogen gas at an elevated temperature so as to effect hydrogenation and disproportionation without decrepitation of the rare earth alloy;

mechanically processing the disproportionated rare earth alloy; and degassing the mechanically processed rare earth alloy so as to effect hydrogen desorption and recombination of the mechanically processed rare earth alloy, wherein the rare earth alloy is a solid material and does not break apart into a powder.

2. The process according to claim 1, wherein the rare earth alloy is selected from NdFeB, $SmCo_5$, $Sm_2(Co,Fe,Cu,Zr)_{17}$ and $SrFe_{12}O_{19}$.

3. The process according to claim 1, wherein the rare earth alloy is NdFeB.

4. The process according to claim 1, wherein the pressure of the hydrogen gas is from 1 mbar to 20 bar.

5. The process according to claim 1, wherein the rare earth alloy is exposed to hydrogen gas for a period of time from 30 minutes to 48 hours.

6. The process according to claim 1, the rare earth alloy is constrained during the step of exposing the rare earth alloy to hydrogen gas.

7. The process according to claim 6, wherein the rare earth alloy is constrained within a constraining element selected from a mould, a tube, a sleeve, or a ring.

8. The process according to claim 1, further comprising the steps of casting a molten rare earth alloy into a mould and solidifying the molten rare earth alloy, prior to exposing the rare earth alloy to hydrogen gas.

9. The process according to claim 8, wherein the cast rare earth alloy remains within the mould during the step of exposing the rare earth alloy to hydrogen gas.

10. The process according to claim 6, wherein the elevated temperature is at least 400° C.

11. The process according to claim 1, wherein the elevated temperature is at least 600° C.

12. The process according to claim 1, wherein the elevated temperature is no more than 1000° C.

13. The process according to claim 1, wherein mechanically processing the disproportionated rare earth alloy comprises pressing, rolling, compacting, shaping, and/or extruding the disproportionated rare earth alloy.

14. The process according to claim 1, wherein mechanically processing the disproportionated rare earth alloy comprises forming the disproportionated rare earth alloy into sheets.

15. The process according to claim 1, wherein the processed disproportionated rare earth alloy is degassed at a pressure of no more than 100 mBar.

16. The process according to claim 1, wherein the processed disproportionated rare earth alloy is degassed at a temperature of from 600 to 700° C.

17. The process according to claim 1, wherein the process further comprises homogenising the disproportionated rare earth alloy by exposing the disproportionated rare earth alloy to hydrogen gas at a temperature of at least 900° C. for at least 6 hours.

18. The process according to claim 1, wherein the rare earth alloy is a cast ingot, solid sintered magnet, or strip cast flakes.

19. A process for the production of rare earth magnets via a non-powder route, the process comprising the steps of:

exposing a rare earth alloy to hydrogen gas at an elevated temperature so as to effect hydrogenation and disproportionation of the rare earth alloy;

mechanically processing the disproportionated rare earth alloy;

degassing the mechanically processed rare earth alloy so as to effect hydrogen desorption and recombination of the mechanically processed rare earth alloy; and wherein the rare earth alloy is a non-powder bulk solid material and wherein the non-powder bulk solid material is selected from the group consisting of a cast ingot and a solid sintered magnet.

* * * * *